US007530636B2

(12) United States Patent
Colja et al.

(10) Patent No.: US 7,530,636 B2
(45) Date of Patent: May 12, 2009

(54) COMFORT BELT LUMBAR

(75) Inventors: Renato Colja, Windsor (CA); George Kukurozovic, Windsor (CA)

(73) Assignee: L&P Property Management Company, South Gate, CA (US)

( * ) Notice: Subject to any disclaimer, the term of this patent is extended or adjusted under 35 U.S.C. 154(b) by 444 days.

(21) Appl. No.: 11/295,425

(22) Filed: Dec. 5, 2005

(65) Prior Publication Data

US 2006/0152051 A1 Jul. 13, 2006

Related U.S. Application Data

(60) Provisional application No. 60/632,841, filed on Dec. 3, 2004.

(51) Int. Cl.
*A47C 7/46* (2006.01)

(52) U.S. Cl. ..... 297/284.4; 297/284.8

(58) Field of Classification Search ..... 297/284.4, 297/284.8, 284.1
See application file for complete search history.

(56) References Cited

U.S. PATENT DOCUMENTS

| | | | | |
|---|---|---|---|---|
| 3,258,259 | A | 6/1966 | Bohlin | |
| 3,272,877 | A | 9/1966 | Geller et al. | |
| 4,155,592 | A | 5/1979 | Tsuda et al. | |
| 4,309,058 | A | 1/1982 | Barley | |
| 4,462,635 | A | 7/1984 | Lance | |
| 5,197,780 | A * | 3/1993 | Coughlin | 297/284.7 |
| 5,217,278 | A * | 6/1993 | Harrison et al. | 297/284.7 |
| 5,224,757 | A | 7/1993 | Geitz et al. | |
| 5,482,353 | A | 1/1996 | Lance | |
| 5,505,520 | A | 4/1996 | Frusti et al. | |
| 5,507,559 | A | 4/1996 | Lance | |
| 5,518,294 | A * | 5/1996 | Ligon et al. | 297/284.4 |
| 5,685,606 | A | 11/1997 | Lance | |
| 5,716,098 | A | 2/1998 | Lance | |
| 5,769,490 | A | 6/1998 | Falzon | |
| 5,788,328 | A | 8/1998 | Lance | |
| 5,797,652 | A | 8/1998 | Darbyshire | |
| 5,860,700 | A | 1/1999 | Lance | |
| 6,152,531 | A | 11/2000 | Deceuninck | |
| 6,254,186 | B1 | 7/2001 | Falzon | |
| 6,394,546 | B1 | 5/2002 | Knoblock et al. | |
| 6,402,246 | B1 | 6/2002 | Mundell | |
| 6,412,868 | B1 | 7/2002 | Kuster et al. | |

(Continued)

FOREIGN PATENT DOCUMENTS

EP 0 296 938 A1 12/1988

(Continued)

OTHER PUBLICATIONS

PCT International Search Report, PCT/US2005/044094.

*Primary Examiner*—Laurie K Cranmer
(74) *Attorney, Agent, or Firm*—Kang Intellectual Property Law, LLC; Grant D. Kang

(57) ABSTRACT

A seat support includes a panel that is connected to opposite sides of the seat through a pair of fixtures and is operated by an actuator that is connected to at least one of the fixtures. The panel includes a recessed center channel that is bounded by flat side plates and that has apertures extending across the channel. The panel can be made from a single piece of material and may also include top and bottom extensions.

13 Claims, 4 Drawing Sheets

U.S. PATENT DOCUMENTS

| | | | | |
|---|---|---|---|---|
| 6,471,294 | B1 | 10/2002 | Dammermann et al. | |
| 6,520,580 | B1 * | 2/2003 | Hong | 297/284.4 |
| 6,595,585 | B2 | 7/2003 | Mundell | |
| 6,644,740 | B2 | 11/2003 | Holst et al. | |
| 6,652,028 | B2 * | 11/2003 | McMillen | 297/284.4 |
| 6,908,153 | B2 * | 6/2005 | Blendea | 297/284.4 |
| 6,918,634 | B2 | 7/2005 | Elliot | |
| 7,083,233 | B2 * | 8/2006 | Massara et al. | 297/284.4 |
| 7,140,681 | B2 * | 11/2006 | McMillen | 297/284.9 |
| 2002/0149245 | A1 | 10/2002 | Mundell | |
| 2003/0184139 | A1 | 10/2003 | Sloan, Jr. | |
| 2003/0227203 | A1 * | 12/2003 | Mundell | 297/284.4 |
| 2004/0212227 | A1 | 10/2004 | Farquhar et al. | |
| 2005/0017555 | A1 | 1/2005 | Elliot | |
| 2005/0023873 | A1 | 2/2005 | Massara et al. | |
| 2006/0273643 | A1 * | 12/2006 | McMillen | 297/284.4 |

FOREIGN PATENT DOCUMENTS

| | | | |
|---|---|---|---|
| EP | 0 420 814 | A1 | 4/1991 |
| EP | 0 508 964 | A1 | 10/1992 |
| EP | 0 518 830 | A1 | 12/1992 |
| EP | 0 540 481 | A1 | 5/1993 |
| EP | 0 582 821 | A1 | 2/1994 |
| FR | 2 596 334 | A1 | 10/1987 |
| FR | 2 765 531 | A1 | 1/1999 |
| GB | 526572 | | 9/1940 |

* cited by examiner

COMFORT BELT LUMBAR

CROSS-REFERENCE TO RELATED APPLICATIONS

This application claims priority to U.S. App. No. 60/632,841, filed on Dec. 3, 2004 which is herein incorporated by reference.

BACKGROUND OF THE INVENTION

1. Field of the Invention

The present invention relates to lumbar supports for seats, and more particularly to seats having a belt-type lumbar support.

2. Related Art

Many different types of strap lumbar supports have been used in seating systems. Strap or belt-type lumbar supports can be any type of strap, including a belt or wire, and are known to be supported in the seat frame by various means, including springs, hooks, brackets, clips, and wires. Strap lumbar supports are also known to be operated using a number of different actuation devices. An example of a prior art belt lumbar support is shown in FIGS. 1A and 1B of the accompanying drawings. Other examples of prior art strap lumbar devices can be found in the following references: U.S. Pat. No. 3,258,259, U.S. Pat. No. 3,273,877, U.S. Pat. No. 4,155,592, U.S. Pat. No. 4,309,058, U.S. Pat. No. 4,462,635, U.S. Pat. No. 5,224,757, U.S. Pat. No. 5,482,353, U.S. Pat. No. 5,507,559, U.S. Pat. No. 5,685,606, U.S. Pat. No. 5,716,098, U.S. Pat. No. 5,769,490, U.S. Pat. No. 5,788,328, U.S. Pat. No. 5,797,652, U.S. Pat. No. 5,860,700, U.S. Pat. No. 6,152,531, U.S. Pat. No. 6,254,186, U.S. Pat. No. 6,394,546, U.S. Pat. No. 6,412,868, U.S. Pat. No. 6,471,294, U.S. Pat. No. 6,644,740, U.S. Pat. No. 6,918,634, US 2005/0023873, US 2004/0212227, EP 0296938, EP 0420824, EP 0540481, EP 0518830, EP 0582821, GB526572, FR 2596334, and FR 2765531.

Strap lumbar devices can usually be distinguished from arching lumbar devices, such as described and illustrated in U.S. Pat. No. 6,003,941 and U.S. Pat. No. 5,518,294, based on the difference between their respective tensioning elements. The strap lumbar is connected to the seat frame in a manner that the tensioning element must be pulled taut to increase support, and the tensioning element can be the strap itself, as with the belts in U.S. Pat. No. 4,155,592, or another structure, as with the Bowden cable in EP 0296938, or a combination thereof as with support and cables in U.S. Pat. No. 6,152,531. In comparison, the tensioning element in the arching lumbar is stiff and can be rotated, pushed or bowed to increase support. As particularly illustrated in FIGS. 1A and 1B, even in the case where the strap lumbar includes a rather stiff belt 2, the belt 2 is connected to a seat frame 6 through a traction cable 4. Increasing tension in the traction cable 4 pulls the belt 2 taut but does not arch the belt 2. As discussed below with reference to the present invention, the preferred traction cable 4 is a Bowden cable 50 which has a sheath 52 surrounding an inner wire core 54 that can slide within the sheath 52.

In belt lumbar devices, there are a number of different designs for the support elements and their cooperative relationship with the tensioning elements. Many strap lumbar supports are more flexible than the belt lumbar supports. Some supports form a part of the tensioning element and are themselves pulled taut between the seat frame, whereas other supports are merely pressed forward into the seat as the tensioning element is pulled taut.

Modular seat assembly techniques require components to be designed for ease and speed of assembly. Accordingly, along with the need for strong, economical, compact components in seat design, there is a continuing need in seat assembly procedures to increase the economy, speed and efficiency of component assembly and shipping. Furthermore, as described in US Pub. No. 2004/0108760 and U.S. Pat. No. 5,553,919, there is a benefit for providing spinal relief when supporting the spine or for using a shaped pad to provide comfort. It is preferable to apply lumbar supporting pressure bilaterally adjacent to the spinal column, while maintaining a vertical recess or channel to accommodate the vertebrae, because the bony vertebrae of the spine may become uncomfortable if direct pressure is applied to them by a lumbar support pressure surface.

SUMMARY OF THE INVENTION

According to one aspect of the present invention, a seat support includes a panel that is connected to opposite sides of the seat through a pair of fixtures and is operated by an actuator that is connected to at least one of the fixtures. The panel includes a recessed center channel that is bounded by planar side plates. The panel can also include extensions at the top and bottom.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
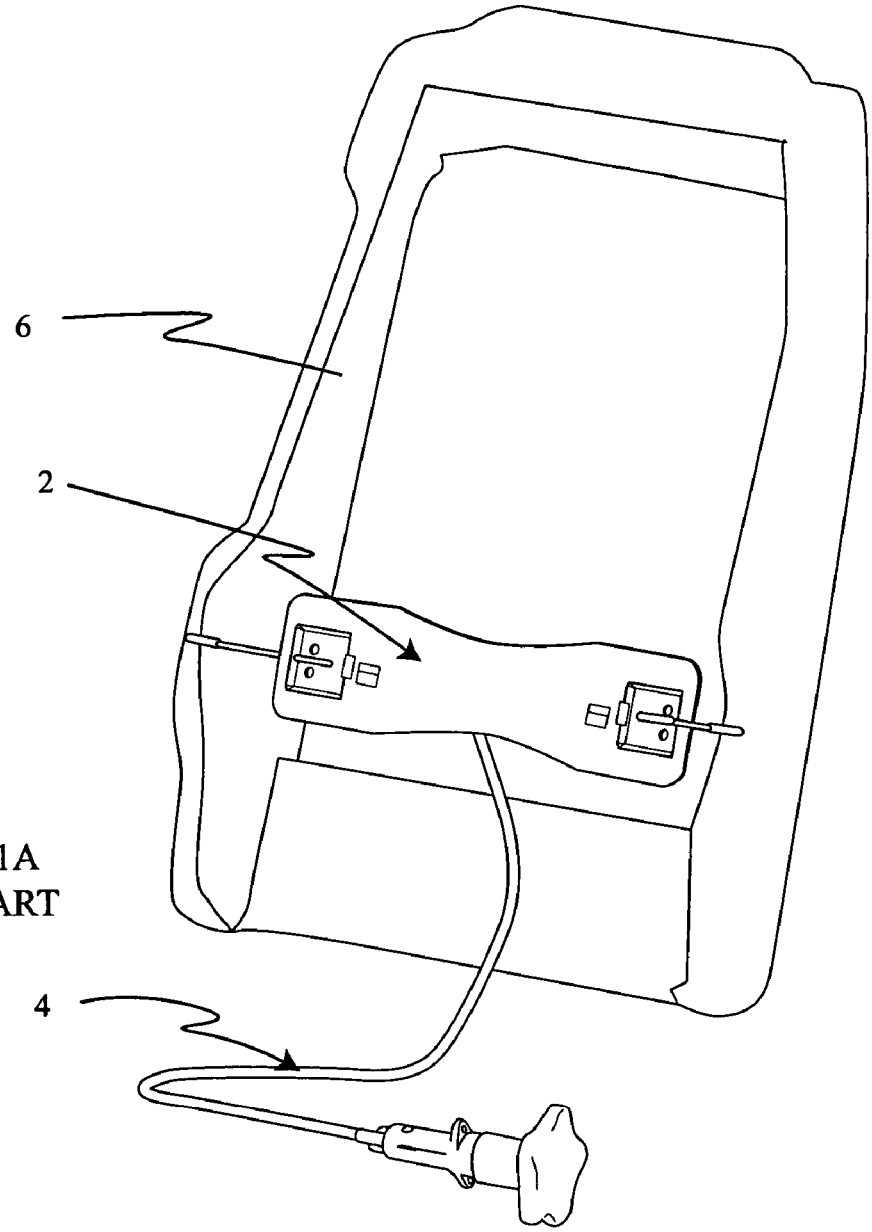
Figure 1A PRIOR ART
FIGS. 1A and 1B are views of a prior art design for a belt lumbar.
Figure 1B:
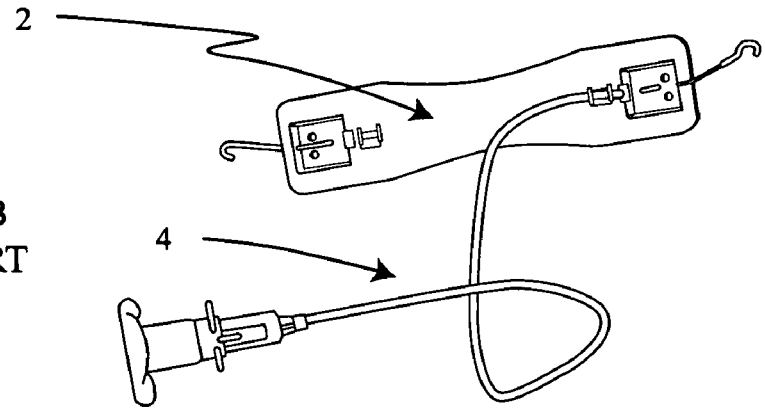
Figure 1B PRIOR ART
Figure 2A:
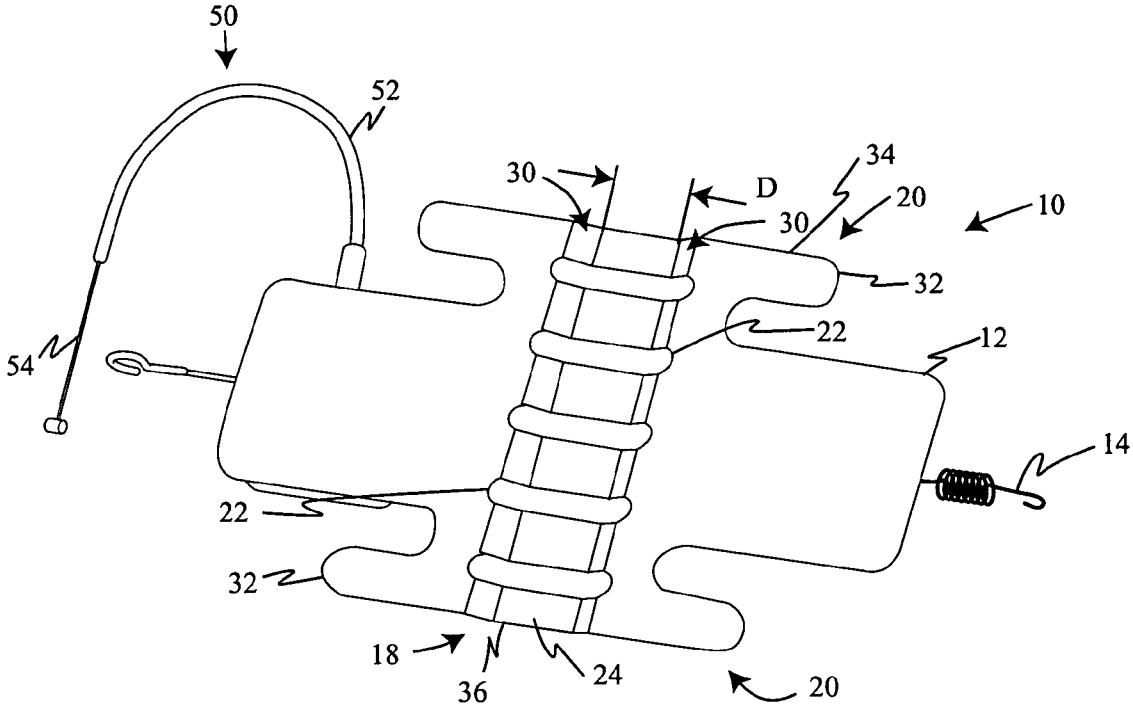
FIGS. 2A and 2B are front and back, perspective views of the belt lumbar according to the present invention, respectively.
Figure 2B:
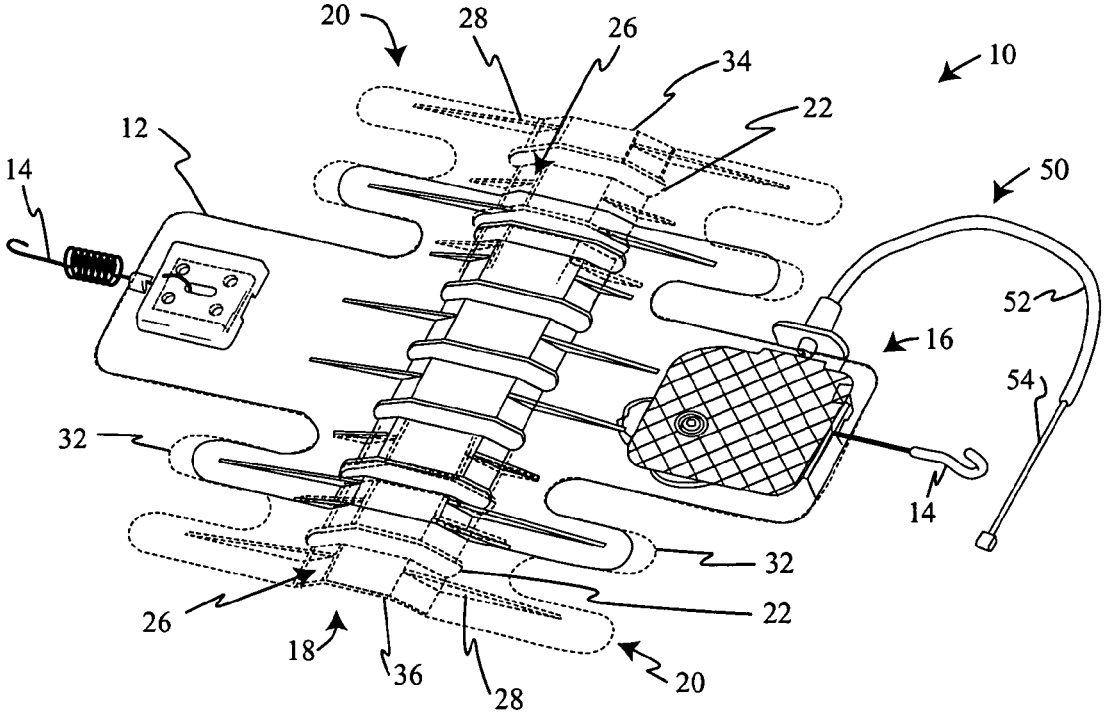

Referring to the accompanying drawings in which like reference numbers indicate like elements, FIGS. 2A and 2B illustrate perspective views of a belt lumbar 10 according to the present invention. The belt lumbar 10 includes a panel 12, a pair of fixtures 14, and an actuator 16 with a tensioning element connecting the panel 12 to a seat (not shown) through at least one of the fixtures 14. The panel is connected to opposite sides of the seat through the fixtures 14 and can be pulled taut in the seat by the actuator or the tensioning element of the actuator may be pulled taut to force the panel 12 forward into the seat.

The panel 12 includes a recessed center channel 18 that is bounded by planar side plates 20 and may include apertures 22 extending across the channel. The recessed center channel 18 has a bottom trough 24 between a pair of sloping, faceted sides 26, and can be formed by concave ribs 30 that extend between the pair of side plates 20, i.e. extending transverse to the recessed center channel 18 and separated by the apertures 22 in a spaced relationship. As particularly illustrated in FIG. 2, the side plates 20 are preferably formed with ridges 28 that are in line with and connect to the concave ribs 30. The ridges 28 extend transversely to the channel 18.

The faceted sides 26 of the recessed center channel 18 are separated by a distance D. In the depicted embodiment, the faceted sides 26 are preferably separated by at least 30 mm. The side plates 20 extend transversely on either side of the recessed center channel 18 in an elongated manner, i.e. the side plates 20 are more than twice as wide in comparison to the recessed center channel 18 or more than twice as wide as the distance D.

The size of the ridges 28 can be changed, increased or decreased, to vary the stiffness of the panel 12 in the direction transverse to the channel 18. The size of the apertures 22, i.e. width and spacing of the ribs 30, can also be varied to alter the stiffness of the panel 12 along the axis of the channel 18. It will also be appreciated that the number and size of the finger extensions 32 can also be varied to change the size of the support region. Generally, the side panels are more stiff or rigid in comparison with the channel 18.

Figure 3A:
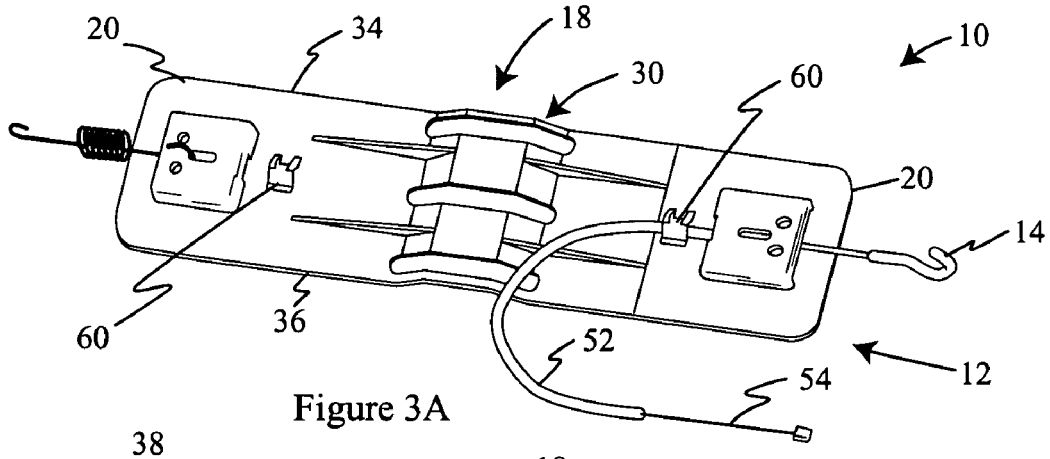
FIGS. 3A, 3B and 3C are back views of alternative embodiments of the belt lumbar according to the present invention.
Figure 3B:
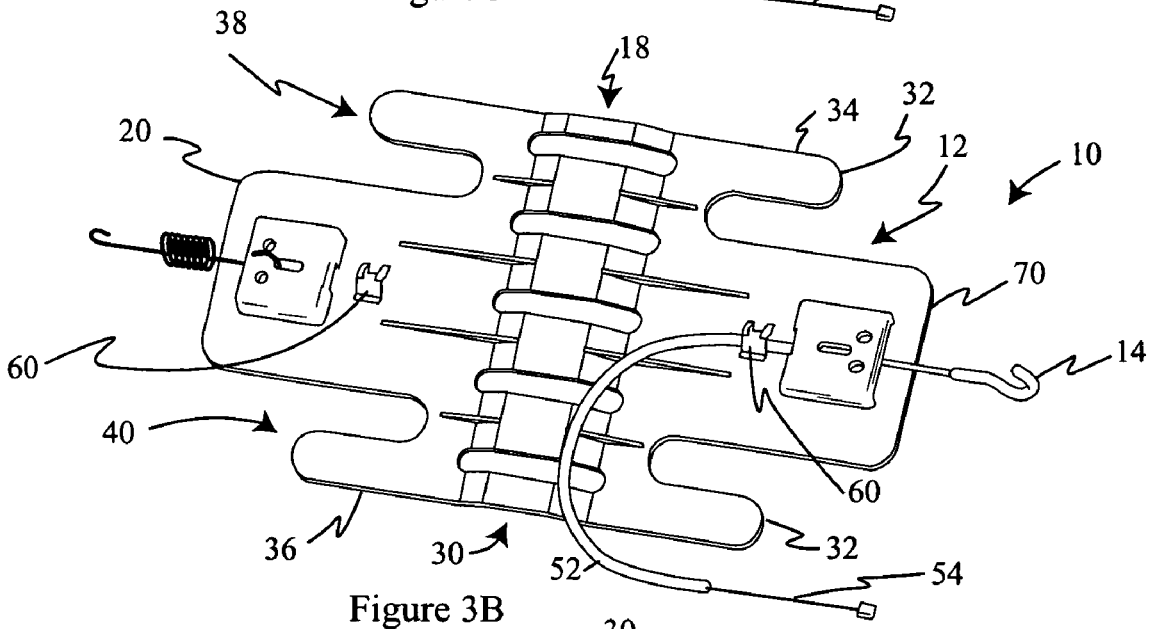
Figure 3C:
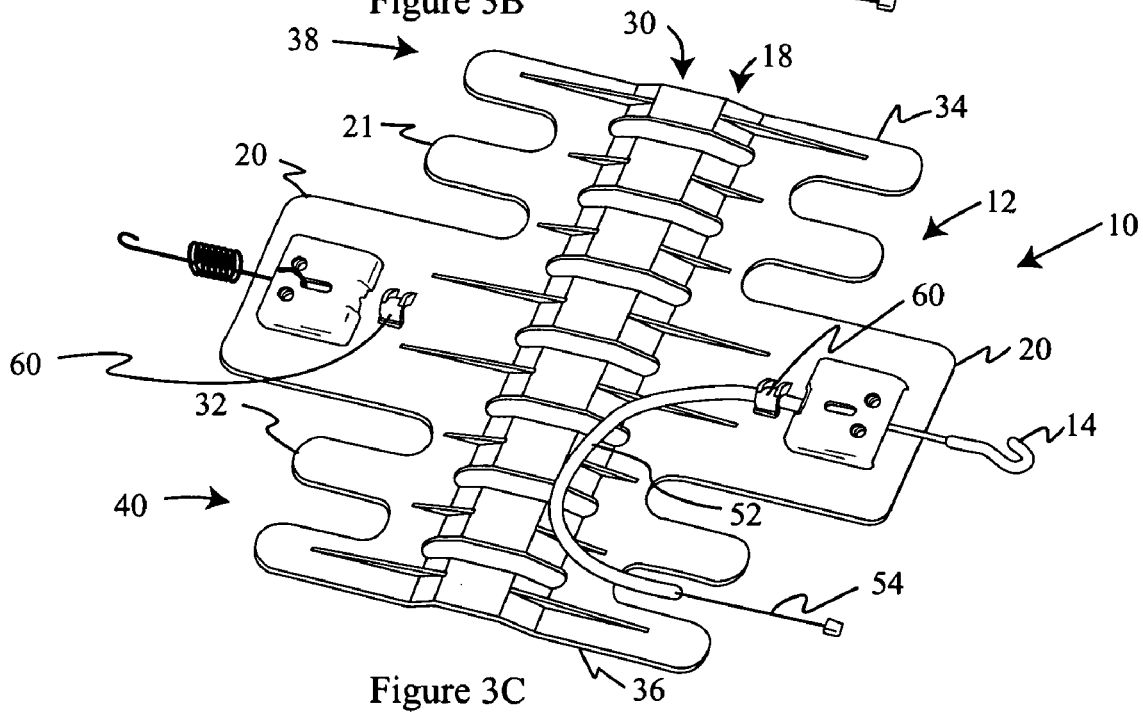

The recessed center channel 18 preferably extends entirely along the length of the panel's centerline, from a top edge 34 to a bottom edge 36 shown in each of the preferred embodiments, as particularly illustrated in FIGS. 3A, 3B and 3C. In FIG. 3A, the pair of side plates 20 and top and bottom ribs 30 form a panel 12 with straight top and bottom edges 34, 36. As illustrated in FIGS. 3B and 3C, the panel 12 could also have a top extension 38 and a bottom extension 40. In each of these embodiments, either one or both of these top and bottom extensions 38, 40 may also have side plates 20. These side plates 20 may also have flexible projections (or fingers) 32 extending transversely to the recessed channel 18 and in line with the concave ribs 30.

It will be appreciated that the panel 12 can be attached to a seat frame (not shown) through springs, hooks, brackets, clips, wires, and any other equivalent fastener or connector hardware. In the preferred embodiment, the tensioning element of the actuator 16 is a Bowden cable 50 which has a sheath 52 surrounding an inner wire core 54 that can slide within the sheath 52. The actuator 16 can be operated by a manual device, such as a hand wheel or lever, or by a powered device, such as an electric motor and gear assembly. The sheath 52 is attached to the panel 12 by a clip 60 and the wire core 54 extends to the connector 14.

From the prior art devices, it will be appreciated that there are a number of ways to connect the panel 12 to the seat frame 6 and provide tension thereto by one or more actuators 16. For example, as with U.S. Pat. No. 6,152,531, the panel may be mounted to the frame through springs or other brackets and may have a tensioning element on each side of the panel. Alternatively, the Bowden cable may extend behind the panel from one side to the other, such as in EP 0296938. For the embodiments described above, it will be particularly noted that there is a clip 60 on each side of the panel 12 which can accommodate the sheath 52 for a Bowden cable that extends behind the panel 12 or for an actuator 16 on each side of the panel 12.

Figure 4A:
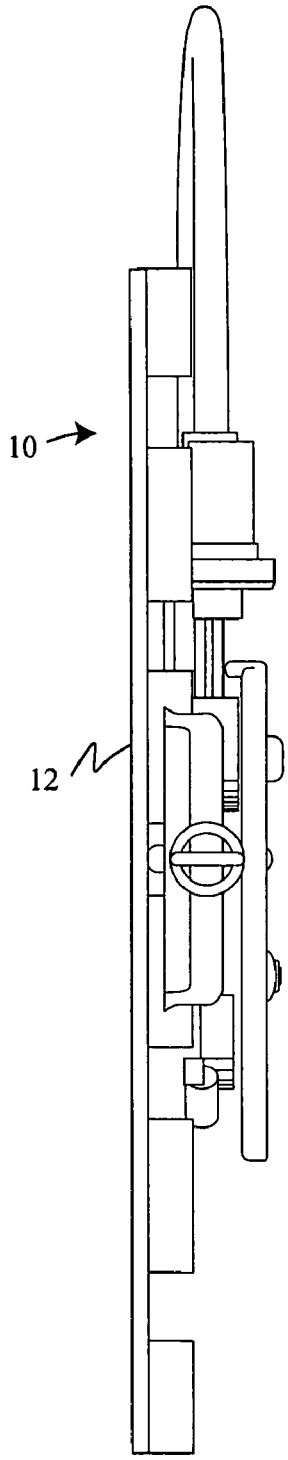
FIGS. 4A, 4B and 4C are side views of alternative embodiments of the belt lumbar according to the present invention.
Figure 4B:
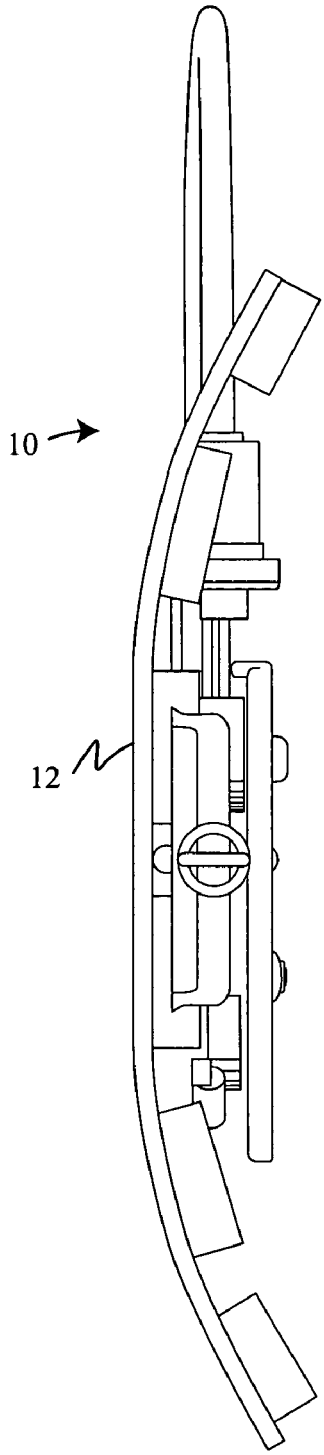
Figure 4C:
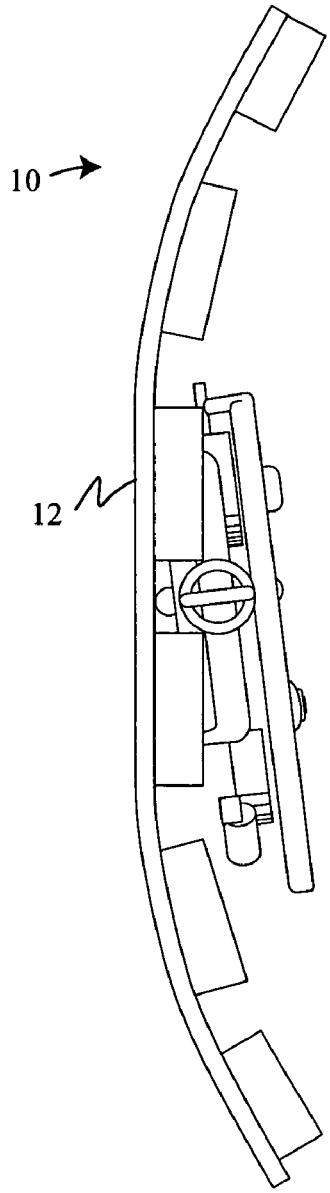

As illustrated in FIGS. 4A, 4B and 4C, the panel 12 can be formed with different support profiles. The panel 12 in FIG. 4A is relatively flat, whereas the panels 12 in FIGS. 4B and 4C are arcuate, having an arc and a three-fold curve. Each of the panels in FIGS. 4A, 4B and 4C are similar in that they are substantially planar as they extend transversely from the recessed center channel 18.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A lumbar support for a seat, comprising:

a lumbar support panel having a recessed center channel laterally bounded by a pair of side plates, wherein said lumbar support panel further comprises a top edge and a bottom edge and said recessed center channel extends entirely from said top edge to said bottom edge, and wherein said side plates transversely extend from said center channel in an elongated manner, a pair of fixtures attached to said side plates and connecting said lumbar support panel to opposite sides of the seat; and an actuator operatively connected to at least one of said pair of fixtures.

2. The lumbar support as set forth in claim 1, wherein said recessed center channel comprises a plurality of apertures.

3. The lumbar support as set forth in claim 2, wherein said apertures form a plurality of concave ribs extending between said pair of side plates transverse to said recessed center channel.

4. The lumbar support as set forth in claim 3, wherein each of said pair of side plates further comprise a plurality of ridges extending transversely to said channel, wherein said ridges respectively are in line with and connect to said concave ribs.

5. The lumbar support as set forth in claim 1, wherein said recessed center channel further comprises a bottom trough between a pair of sloping, faceted sides.

6. The lumbar support as set forth in claim 1, wherein said recessed center channel comprises a plurality of apertures, wherein at least one of said apertures extends between said pair of side plates.

7. The lumbar support as set forth in claim 1, wherein said lumbar support panel further comprises a top extension and a bottom extension, each of which comprise an extended portion of said a recessed center channel bounded by extended portions of said a pair of side plates.

8. The lumbar support as set forth in claim 7, wherein each said extended portions of said side plates further comprise a finger extension projecting transversely.

9. The lumbar support as set forth in claim 1, wherein said fixtures are selected from the group of connectors consisting of springs, hooks, brackets, clips, wires, and any combination thereof.

10. The lumbar support as set forth in claim 1, wherein said actuator is comprised of a bowden cable.

11. A lumbar support for a seat, comprising:

a lumbar support panel having a recessed center channel laterally bounded by a pair of side plates, wherein said lumbar support panel further comprises a top edge and a bottom edge and said recessed center channel extends entirely from said top edge to said bottom edge, wherein said side plates transversely extend from said center channel in an elongated manner, and wherein said panel further comprises at least one of a top extension and a bottom extension with an extended portion of said a recessed center channel;

a pair of fixtures attached to said side plates and connecting said panel to opposite sides of the seat; and an actuator operatively connected to at least one of said pair of fixtures, wherein said actuator is comprised of a bowden cable.

12. The lumbar support as set forth in claim 11, wherein said recessed center channel comprises a plurality of apertures.

13. The lumbar support as set forth in claim 11, wherein said recessed center channel further comprises a bottom trough between a pair of sloping, faceted sides.

* * * * *